United States Patent [19]

Taguchi

[11] Patent Number: 4,903,303

[45] Date of Patent: Feb. 20, 1990

[54] MULTI-PULSE TYPE ENCODER HAVING A LOW TRANSMISSION RATE

[75] Inventor: Tetsu Taguchi, Tokyo, Japan

[73] Assignee: NEC Corporation, Tokyo, Japan

[21] Appl. No.: 153,290

[22] Filed: Feb. 4, 1988

[30] Foreign Application Priority Data

Feb. 4, 1987 [JP] Japan ..... 62-25028

[51] Int. Cl.[4] ..... G10L 5/00

[52] U.S. Cl. ..... 381/31; 381/49

[58] Field of Search ..... 381/47–49

[56] References Cited

U.S. PATENT DOCUMENTS 4,701,954 10/1987 Atal ..... 381/49
4,720,865 1/1988 Taguchi ..... 381/49
4,731,846 3/1988 Secrest ..... 381/49
4,776,015 10/1988 Takeda et al. ..... 381/47

*Primary Examiner*—Emanuel S. Kemeny
*Attorney, Agent, or Firm*—Sughrue, Mion, Zinn, Macpeak & Seas

[57] ABSTRACT

In an encoder for encoding a speech signal having a spectrum envelope into a plurality of excitation pulses, a spectrum emphasis unit emphasizes peak components of the spectrum envelope to produce an emphasized speech signal. As a result of a spectrum emphasis operation, the emphasized speech signal has an emphasized spectrum envelope which substantially comprises a plurality of line spectra. Responsive to the emphasized speech signal, a pulse producing unit produces a plurality of excitation pulses by the use of a pulse search method.

5 Claims, 7 Drawing Sheets

MULTI-PULSE TYPE ENCODER HAVING A LOW TRANSMISSION RATE

BACKGROUND OF THE INVENTION

This invention relates to an encoder of a multi-pulse type for use in encoding a speech signal into a plurality of excitation pulses specifying an exciting source or a vocal tract through which the speech signal is produced.

A conventional encoder of the type described is disclosed in U.S. application Ser. No. 726,583 filed Apr. 23, 1985, by Tanaka et al and assigned to the instant assignee. The encoder is used in general for a data transmission system in combination with a decoder which is used as a counterpart of the encoder.

In the encoder, the speech signal is divided into a sequence of frames. The speech signal is encoded into a plurality of excitation pulses for each frame by the use of a pulse search method known in the art. Each of the excitation pulses has an amplitude and a location determined by the speech signal. Excitation pulse information is transmitted from the encoder to the decoder through a transmission medium. The decoder decodes the excitation pulse information into a decoded signal and outputs the decoded signal as a synthetic speech signal.

The number of the excitation pulses per single frame is determined by performance of the encoder. When the excitation pulses are reduced in number, the synthetic speech signal degrades in quality. On the other hand, the number of the excitation pulses determines a transmission rate of the data transmission system. Namely, the transmission rate reduces in proportion to the number of the excitation pulses. It is preferable to reduce the transmission rate in view of reduction of a transmission bandwidth. A recent demand is directed to a low transmission rate of, for example, 4.8 kbits/sec. In consideration of the number of the excitation pulses, the transmission rate of the encoder of the Tanaka et al patent must be 8 kbits/sec at the lowest.

In the meanwhile, pre-emphasis operation is well known in the art as a useful method which is capable of raising an SNR (signal to noise ratio) of the encoder. For this purpose, the encoder comprises a pre-emphasis filter which is for emphasizing high frequency component of the speech signal. The pre-emphasis filter flattens a spectrum envelope of the speech signal. In the case, the decoder needs a de-emphasis filter which has an inverse filter characteristic relative to the pre-emphasis filter.

SUMMARY OF THE INVENTION

It is therefore an object of this invention to provide an encoder which is suitable for a data transmission system having a low transmission rate.

It is another object of this invention to provide an encoder of the type described, which can be realized without degrading a synthetic speech signal produced in a counterpart decoder.

It is still another object of this invention to provide an encoder applying a pre-emphasis operation, which can omit a de-emphasis operation in a counterpart decoder.

An encoder to which this invention is applicable is for use in encoding a speech signal into a plurality of pulse signals. Each has an amplitude and a location determined by the speech signal. According to this invention, the encoder comprises spectrum emphasis means responsive to the speech signal for emphasizing peak components of a spectrum envelope of the speech signal to produce an emphasized speech signal and pulse producing means coupled to the spectrum emphasis means for producing the plurality of pulse signals in response to the emphasized speech signal.

DESCRIPTION OF THE PREFERRED EMBODIMENT:

PRINCIPLE OF THE INVENTION

Figure 1:
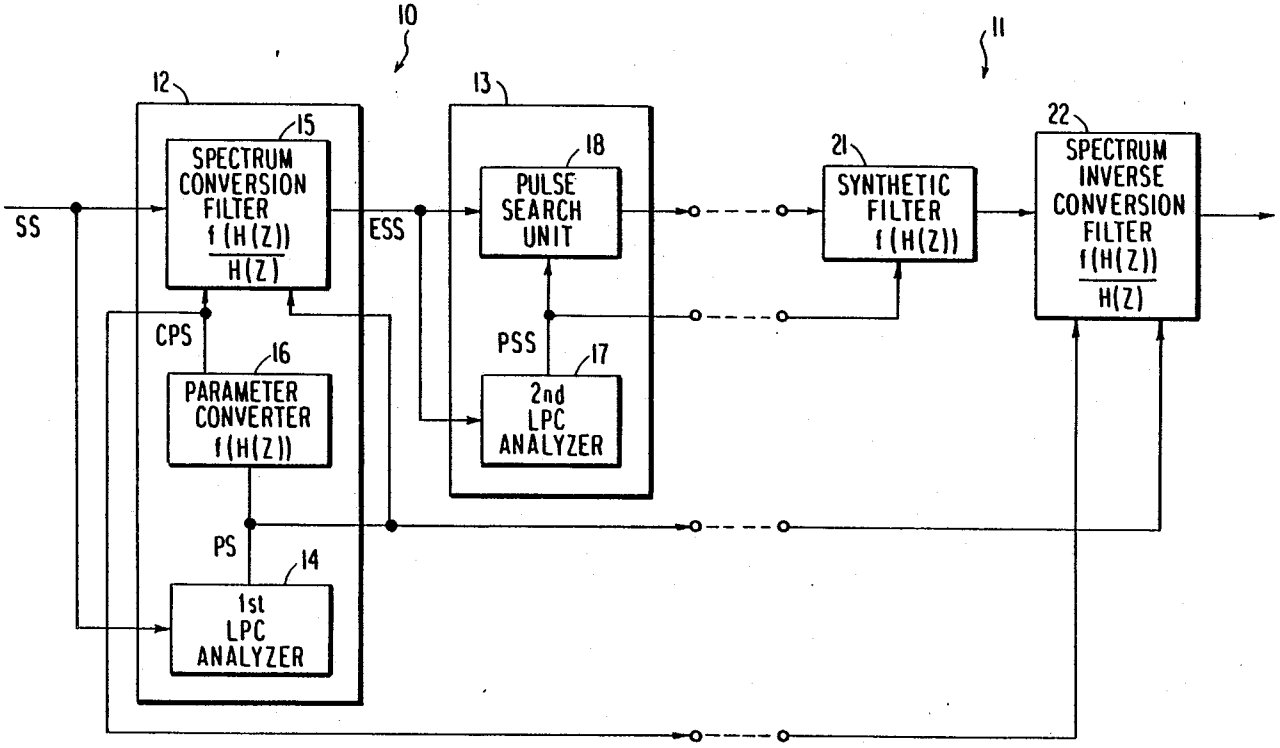
FIG. 1 is a block diagram for use in describing principles of an encoder according to this invention.
Figure 2:
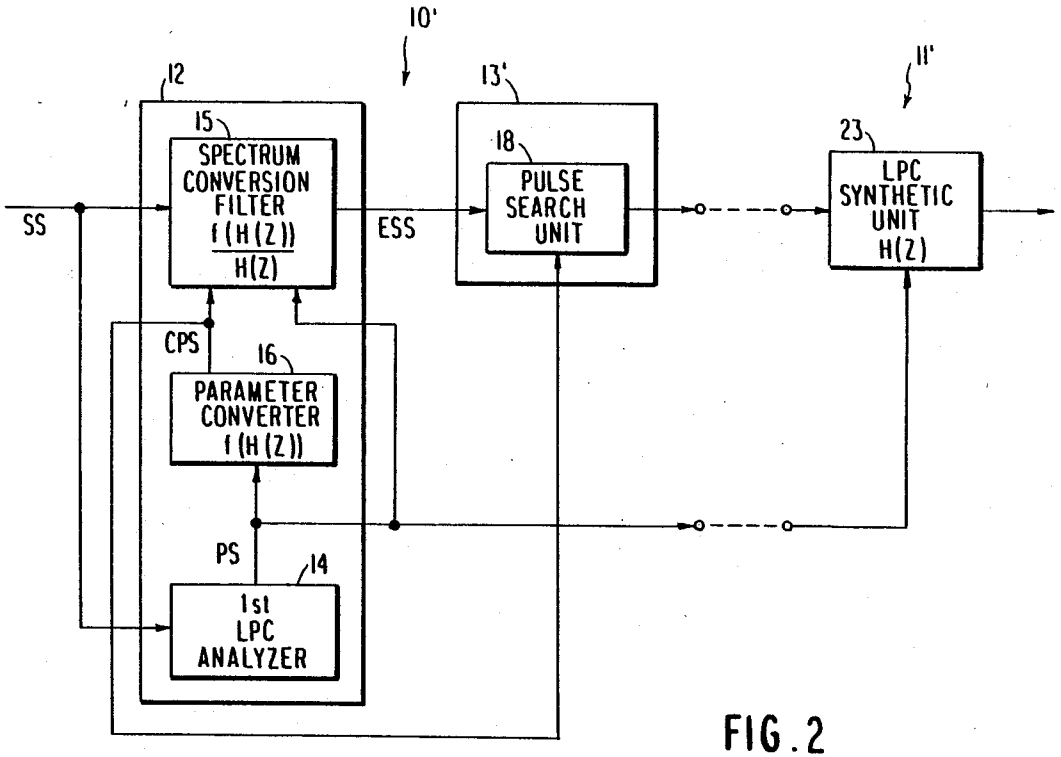
FIG. 2 is a block diagram for use in describing effects of an encoder according to this invention.

Referring to FIGS. 1 and 2, principles of the present invention will be described at first. To put it briefly, an encoder according to this invention is characterized in that a spectrum envelope of the speech signal is emphasized before an encoding operation by the use of a spectrum emphasis unit. The spectrum emphasis unit is implemented by a filter circuit which has a predetermined transfer function. In this connection, it may be said at this stage of description that a decoder needs an additional filter circuit which has an inverse transfer function relative to the predetermined transfer function of the filter circuit of the encoder. The additional filter circuit can, however, be omitted in the decoder which is used as a counterpart of the encoder according to this invention. The reason will presently be described.

In FIG. 1, an encoder 10 according to this invention is illustrated together with a decoder 11 which is used as a counterpart of the encoder 10. The encoder 10 comprises a spectrum emphasis unit 12 and a pulse producing unit 13. A speech signal SS is supplied to the spectrum emphasis unit 12.

The spectrum emphasis unit 12 comprises a first LPC (Linear Predictive Coding) analyzer 14, a spectrum conversion filter 15, and a parameter converter 16. It will be assumed that the speech signal SS has a spectrum envelope H(z) defined by the frequency spectrum. In this event, an output signal produced by the spectrum conversion filter 15 may have a spectrum envelope f(H(z)) related to the spectrum envelope H(z). Supplied with the speech signal SS, the first LPC analyzer 14 calculates LPC parameters of the spectrum envelope H(z) and produces a first LPC parameter signal PS representative of the spectrum envelope H(z). The first LPC parameter signal PS is supplied to the spectrum conversion filter 15 and the parameter converter 16.

The parameter converter 16 converts the first LPC parameter signal PS into a converted LPC parameter signal CPS which represents the spectrum envelope f(H(z)). The parameter converter 16 delivers the converted LPC parameter signal CPS to the spectrum conversion filter 15. The spectrum conversion filter 15 has a transfer function which is given by f(H(z))/H(z). Supplied with the speech signal SS, the first LPC parameter signal PS, and the converted LPC parameter signal CPS, the spectrum conversion filter 15 converts the spectrum envelope H(z) into a converted speech signal which has the spectrum envelope f(H(z)). The spectrum conversion filter 15 delivers the converted speech signal as an emphasized speech signal ESS to the pulse producing unit 13. Under the circumstances, spectrum emphasis operation of the spectrum emphasis unit 12 may be called a spectrum emphasis operation.

The pulse producing unit 13 comprises a second LPC analyzer 17 and a pulse search unit 18. Supplied with the emphasized speech signal ESS, the second LPC analyzer 17 calculates LPC parameters of the spectrum envelope f(H(z)) and produces a second LPC parameter signal PSS. The pulse search unit 18 is supplied with the emphasized speech signal ESS and the second LPC parameter signal PSS. The pulse search unit 18 determines a predetermined number of excitation pulses in the manner known in the art and produces the excitation pulses. Needless to say, each of the excitation pulses has an amplitude and a location. In addition to information of the excitation pulses and the second LPC parameter signal PSS, information of the second LPC parameter signal PS and the converted LPC parameter signal CPS are transmitted from the encoder 10 to the decoder 11 through a transmission medium represented by dashed lines.

The decoder 11 comprises a synthetic filter 12 having a first transfer function f(H(z)) and a spectrum inverse conversion filter 22 having a second transfer function H(z)/f(H(z)). Supplied with the information of the excitation pulses and the second LPC parameter signal PSS, the synthetic filter 21 reproduces a synthetic speech signal which has the spectrum envelope f(H(z)). The synthetic speech signal is supplied to the spectrum inverse conversion filter 22. The spectrum inverse conversion filter 22 converts the synthetic speech signal into a converted speech signal which has the spectrum envelope H(z).

In the encoder 10, the second LPC analyzer 17 can be omitted because the second parameter signal PSS represents the spectrum envelope f(H(z)) and is identical with that of the converted parameter signal CPS. In the decoder 11, a combination of the synthetic filter 21 and the spectrum inverse conversion filter 22 can be implemented by an LPC synthetic unit which has the transfer function H(z). This is because a combined transfer function of the synthetic filter 21 and the spectrum inverse conversion filter 22 is represented by:

$$H(z)=f(H(z)).[H(z)/f(H(z))].$$

This is the reason why the spectrum inverse conversion filter 22 can be omitted. In other words, the decoder 11 may not use a special filter, namely, a de-emphasis filter for de-emphasis operation.

Under the circumstances, a structure shown in FIG. 1 is implemented by another structure shown in FIG. 2. In FIG. 2, the pulse producing unit 13 of an encoder 10' does not include the second LPC analyzer 17 shown in FIG. 1. Furthermore, a decoder 11' has an LPC synthetic unit 23 instead of the synthetic filter 21 and the spectrum inverse conversion filter 22 shown in FIG. 1. The LPC synthetic unit 23 comprises a synthetic filter which has the transfer function H(z) and which is known in the art.

EMBODIMENT

Figure 3:
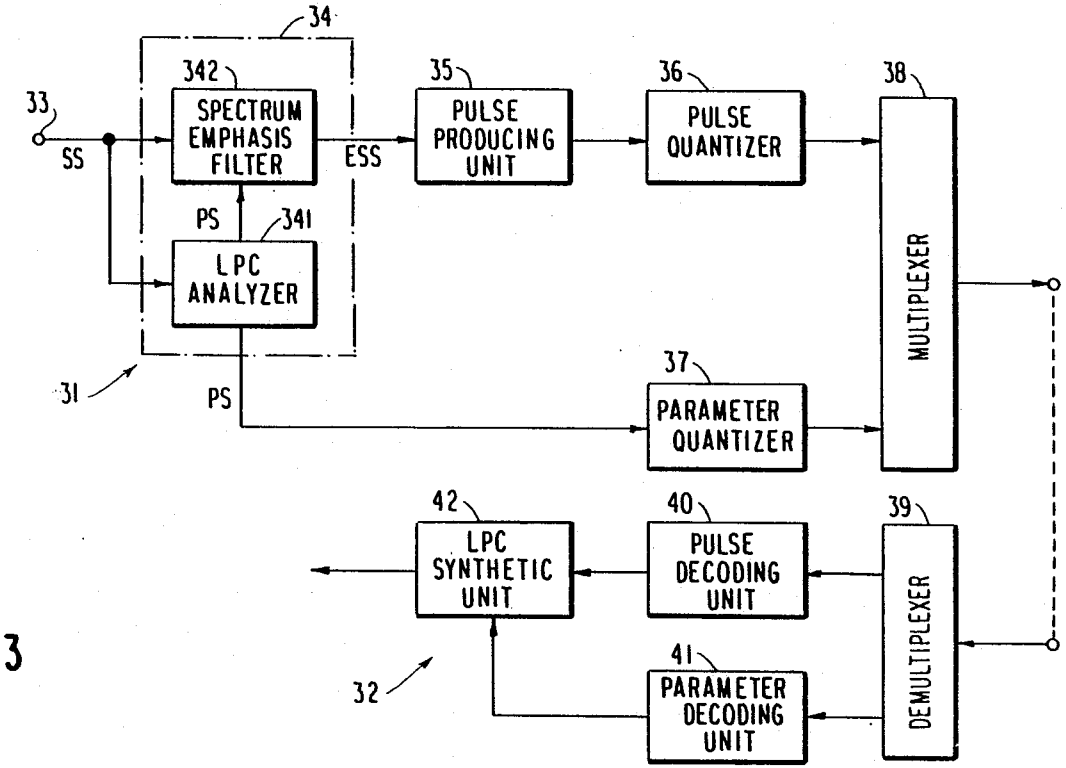
FIG. 3 is a block diagram of an encoder according to a first embodiment of this invention and a decoder for use as a counterpart of the encoder.

Referring to FIG. 3, a multi-pulse-type encoder 31 according to a first embodiment of this invention is used for a data transmission system in combination with a decoder 32 which is used as a counterpart of the encoder 31.

A speech signal SS is supplied to the encoder 31 through an input terminal 33. In general, the speech signal SS is divided into a succession of frames known in the art. It is assumed that each frame lasts for a time interval of, for example, 20 milliseconds and is for arranging N samples. The number of N is determined by a sampling frequency. Following description will be directed to only one frame of the speech signal SS.

The encoder 31 comprises a spectrum emphasis unit 34 and a pulse producing unit 35. The speech signal SS has a spectrum envelope which has a plurality of peak components. The spectrum emphasis unit 34 is for emphasizing peak components of the spectrum envelope and comprises an LPC analyzer 341 and a spectrum emphasis filter 342. Supplied with the speech signal SS, the LPC analyzer 341 carries out an LPC analysis and calculates LPC parameters such as $\alpha$-parameters as called in the art. The LPC analyzer is therefore operable as a calculating unit. The LPC parameters specify the spectrum envelope. The LPC analyzer 341 delivers an LPC parameter signal PS to the spectrum emphasis filter 342. The spectrum emphasis filter 342 has a combined function of the spectrum conversion filter 15 and the parameter converter 16 described in conjunction with FIG. 1. In other words, the spectrum emphasis filter 342 has a predetermined transfer function as will presently be described in detail.

Figure 4:
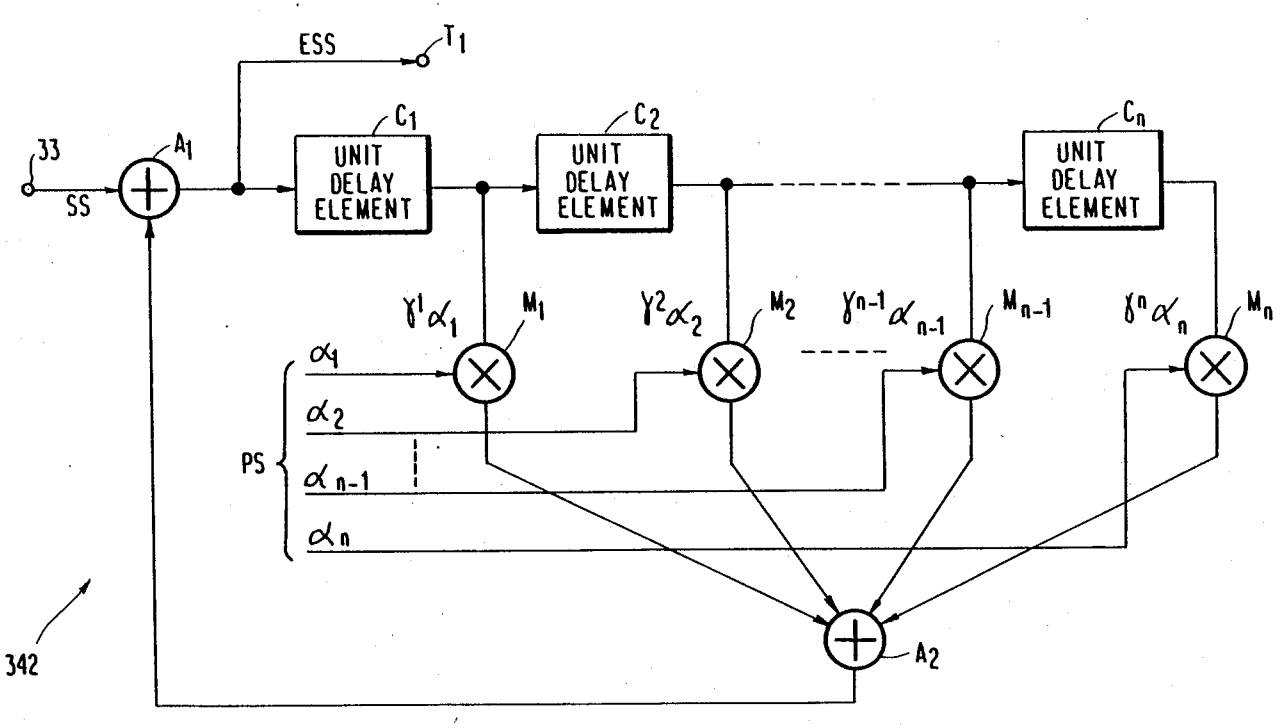
FIG. 4 is a block diagram of a spectrum emphasis filter operable as a part of the encoder illustrated in FIG. 3.

Referring to FIG. 4, the spectrum emphasis filter 342 comprises first and second adders $A_1$ and $A_2$, first through n-th unit delay elements $C_1$ to $C_n$, and first through n-th multipliers $M_1$ to $M_n$. Each of the first through the n-th unit delay elements $C_1$ to $C_n$ has a transfer function $Z^{-1}$. The delay elements $C_1$ through $C_n$ are connected in cascade. The first through the n-th multipliers $M_1$ to $M_n$ have first through n-th attenuation coefficients $\gamma^1$ to $\gamma^n$, respectively. Each of the first through the n-th attenuation coefficients $\gamma^1$ to $\gamma^n$ is experimentally determined and has a value between 0 and 1. The parameter signal PS comprises first through n-th LPC parameters $\alpha_1$ to $\alpha_n$. It is desirable that the number n is determined by one of 9 through 12.

In FIGS. 3 and 4, the speech signal SS is supplied to the first delay element $C_1$ through the first adder $A_1$. First through n-th output signals of the first through the n-th delay elements $C_1$ to $C_n$ are supplied to the first through the n-th multipliers $M_1$ to $M_n$, respectively. For example, the first multiplier $M_1$ multiplies the first output signal by the first LPC parameter $\alpha_1$ and the first attenuation coefficient $\alpha^1$. The first through the n-th multipliers $M_1$ to $M_n$ deliver first through n-th multiplied signals, respectively, to the second adder $A_2$. The second adder $A_2$ calculates a summation of the first through the n-th multiplied signals and delivers the summation to the first adder $A_1$. The first adder $A_1$ adds the summation to the speech signal SS and produces an output signal as an emphasized speech signal ESS.

In the following, a letter "i" will be used to represent either all of or each of 1 through n. By the transfer function $Z^{-1}$, the LPC parameters $\alpha_i$, and the attenuation coefficients $\gamma^i$, the predetermined transfer function of the spectrum emphasis filter 342 is given by:

$$H(\gamma z) = \left(1 - \sum_{i=1}^{n} \alpha_i \gamma^i Z^{-1}\right)^{-1}.$$

In addition, the predetermined transfer function is also given by:

$$H(\gamma z) = f(H(z))/H(z),$$

where f(H(z)) and H(z) represent transfer functions described in conjunction with FIGS. 1 and 2. In the example being illustrated, the transfer function f(H(z)) is therefore restricted by next equation which is given by:

$$f(H(z)) = H(z).H(\gamma z).$$

Thus, the spectrum emphasis filter 342 emphasizes each of the peak components, such as a formant, of the spectrum envelope and produces the emphasized speech signal ESS from a filter output terminal $T_1$. As a result of a spectrum emphasis operation mentioned above, the emphasized speech signal ESS has the spectrum envelope which substantially comprises a plurality of line spectra of a plurality of lines. Each of the line spectra corresponds to each of the peak components because each line spectrum appears by emphasizing each peak component. Needless to say, the spectrum emphasis unit 34 effects the preliminary emphasis operation.

Referring back to FIG. 3, the pulse producing unit 35 is supplied with the emphasized speech signal ESS and carries out a pulse search operation to produce a predetermined number of excitation pulses in the manner which will later be described in detail. Each of the excitation pulses has an amplitude and a location.

In FIG. 3, a pulse quantizer 36 is supplied with the excitation pulses and quantizes every excitation pulse. The pulse quantizer 36 delivers a quantized pulse signal to the multiplexer 38. On the other hand, the LPC parameter signal PS is supplied to a parameter quantizer 37. The parameter quantizer 37 quantizes the LPC parameter signal and delivers a quantized parameter signal to a multiplexer 38. The multiplexer 38 multiplexes the quantized pulse signal and the quantized parameter signal into a multiplexed signal. The multiplexed signal is transmitted through a transmitter (not shown) to a receiver (not shown) through a transmission medium depicted by a dashed lines.

In FIG. 3, the decoder 32 comprises a demultiplexer 39, a pulse decoding unit 40, a parameter decoding unit 41, and an LPC synthetic unit 42. Supplied with the multiplexed signal produced by the encoder 31, the demultiplexer 39 demultiplexes the multiplexed signal into a demultiplexed pulse signal and a demultiplexed parameter signal. The demultiplexed pulse signal is decoded by the pulse decoding unit 40 into a decoded pulse signal. The decoded pulse signal is supplied as reproduced excitation pulses to the LPC synthetic unit 42. On the other hand, the demultiplexed parameter signal is decoded by the parameter decoding unit 41 into a decoded parameter signal. The decoded parameter signal is also supplied as reproduced LPC parameters to the LPC synthetic unit 42. The LPC synthetic unit 42 synthesizes the reproduced excitation pulses and the reproduced LPC parameters in the manner known in the art and produces a synthetic speech signal. It is to be noted that the decoder 32 does not carry out a de-emphasis operation.

Figure 5:
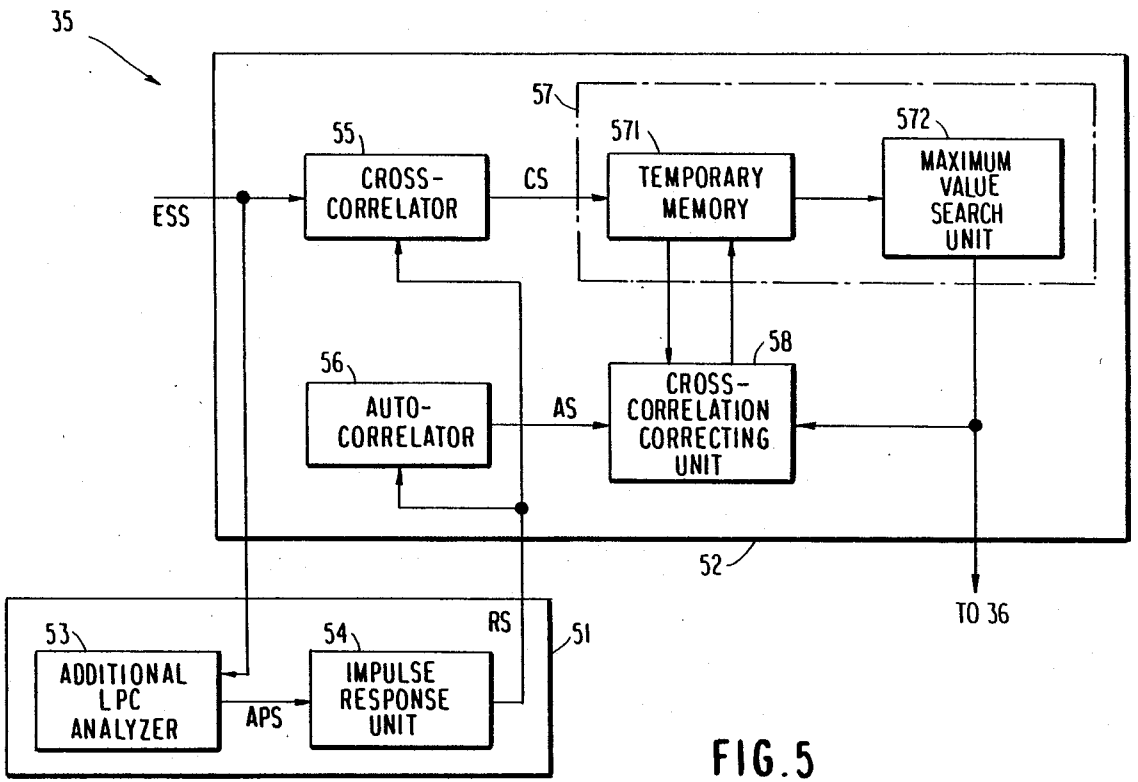
FIG. 5 is a block diagram of a pulse producing unit operable as a part of the encoder illustrated in FIG. 3.

Referring to FIG. 5, description will be made as regards the pulse producing unit 35 which is suitable for the encoder according to this invention. The pulse producing unit 35 is coupled to the spectrum emphasis unit 34 described in conjunction with FIG. 3 and is therefore supplied with the emphasized speech signal ESS. The pulse producing unit 35 comprises an analyzing unit 51 and a pulse search unit 52, each of which is supplied with the emphasized speech signal ESS.

In response to the emphasized speech signal ESS, an additional LPC analyzer 53 of the analyzing unit 51 calculates LPC parameters $\beta_i$ representative of a spectrum envelope of the emphasized speech signal ESS. The additional LPC analyzer 53 delivers an additional LPC parameter signal APS to an impulse response unit 54. The impulse response unit 54 calculates an impulse response of the additional LPC parameter signal APS to produce an impulse response signal RS representative of the impulse response. The impulse response signal RS is delivered to a cross-correlator 55 and an autocorrelator 56 of the pulse search unit 52.

The cross-correlator 55 calculates cross-correlation between the emphasized speech signal ESS and the impulse response signal RS and produces a cross-correlation signal CS representative of the cross-correlation. The cross-correlation signal CS is supplied to a pulse generating unit 57. On the other hand, the autocorrelator 56 calculates autocorrelation of the impulse response signal RS and produces an autocorrelation signal AS representative of the autocorrelation. The autocorrelation signal AS is supplied to a cross-correlation correcting unit 58.

The pulse generating unit 57 comprises a temporary memory 571 and a maximum value search unit 572. The temporary memory 571 is for temporarily memorizing the cross-correlation signal CS as a stored cross-correlation signal. The maximum value search unit 572 reads the stored cross-correlation signal out of the temporary memory 571 and searches a maximum value of cross-correlation components of the stored cross-correlation signal. The maximum value search unit 572 produces the maximum value as a first excitation pulse. The first excitation pulse has a first amplitude and a first location. The first excitation pulse is delivered to the cross-correlation correcting unit 58 and the pulse quantizer 36 described in conjunction with FIG. 3. In response to the first excitation pulse and the autocorrelation signal AS, the cross-correlation correcting unit 58 detects a first autocorrelation component which is identical with that of the first amplitude and the first location of the first excitation pulse. Subsequently, the cross-correlation correcting unit 58 subtracts the first autocorrelation component from the stored cross-correlation signal. The cross-correlation correcting unit 58 delivers remaining cross-correlation components as a corrected cross-correlation signal back to the temporary memory 571. In response, the maximum value search unit 572 searches a next maximum value of the corrected cross-correlation signal stored in the temporary memory 571 and produces a second excitation pulse. The second excitation pulse has a second amplitude and a second location. Pulse search operation mentioned above is repeated during one frame of the emphasized speech signal ESS until the number of the excitation pulses becomes a predetermined number. Thus, the excitation pulses are generated one after another for the frame under consideration.

In the pulse producing unit 35, it is possible to reduce the number of the excitation pulses. This is because the emphasized speech signal ESS has the spectrum envelope which substantially comprises a plurality of line spectra and because the excitation pulses derived from the emphasized speech signal ESS are closely resemble the speech signal SS.

Figure 6:
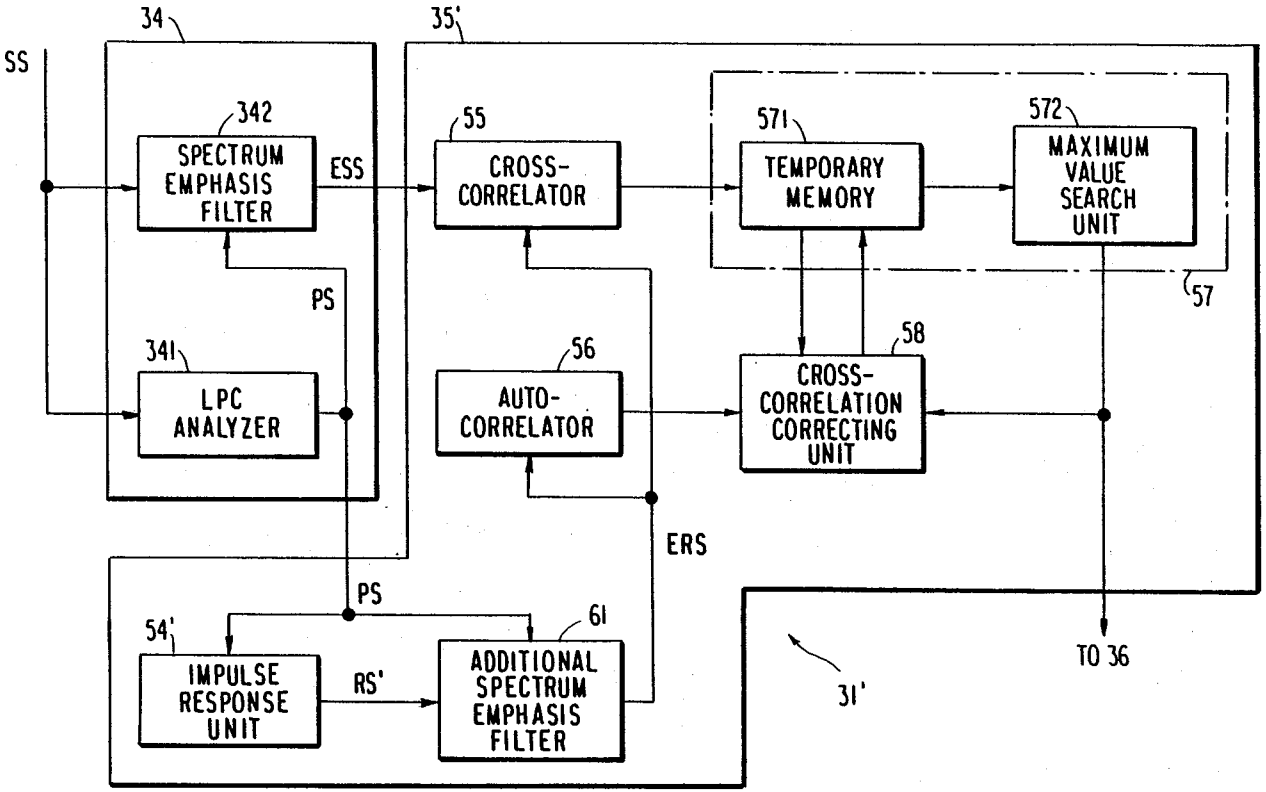
FIG. 6 is a block diagram of a principal part of an encoder according to a second embodiment of this invention, which is a modification of said first embodiment.

Referring to FIG. 6, the description will further proceed to an encoder 31' according to a second embodiment of this invention. The encoder 31' comprises similar parts designated by like reference numerals in conjunction with FIGS. 3 and 5 except for an impulse response unit 54' and an additional spectrum emphasis filter 61. Although not depicted in FIG. 6, the pulse quantizer, the parameter quantizer, and the multiplexer are included in the encoder 31'.

The encoder 31' is characterized in that a pulse producing unit 35' does not include the additional LPC analyzer 53 shown in FIG. 5. For this purpose, the LPC parameter signal PS produced by the LPC analyzer 342 is used for the pulse search operation of the pulse producing unit 35' The pulse producing unit 35' is therefore coupled to the LPC analyzer 341 and the spectrum emphasis filter 342. The LPC analyzer 341 delivers the LPC parameter signal PS representative of the LPC parameters $\alpha_i$ to the spectrum emphasis filter 341, the impulse response unit 54', and the additional spectrum emphasis filter 61. The impulse response unit 54' has the attenuation coefficients $\gamma^i$ described in conjunction with FIG. 4. The impulse response unit 54' calculates an impulse response of the LPC parameters $\alpha_i$ and produces an impulse response signal RS' representative of the impulse response parameters $\alpha_i.\gamma^i$.

The additional spectrum emphasis filter 61 is similar in structure to that illustrated in FIG. 4. Supplied with the impulse response signal RS' and the LPC parameter signal PS, the additional spectrum emphasis filter 61 emphasizes the spectrum envelope of the impulse response signal RS' in accordance with the LPC parameter signal PS and produces an emphasized impulse response signal ERS. The pulse search operation will be omitted because the operation is similar to that described in conjunction with FIG. 5.

In the encoder 31', the pulse producing unit 35' needs the additional spectrum emphasis filter 61 instead of the additional LPC analyzer 53 shown in FIG. 5. The additional spectrum emphasis filter 61, however, has a simple structure in contrast to the additional LPC analyzer 53. The encoder 31' of FIG. 6 has therefore a simple structure and is superior to the encoder 31 illustrated with reference to FIGS. 3 and 5.

Figure 7:
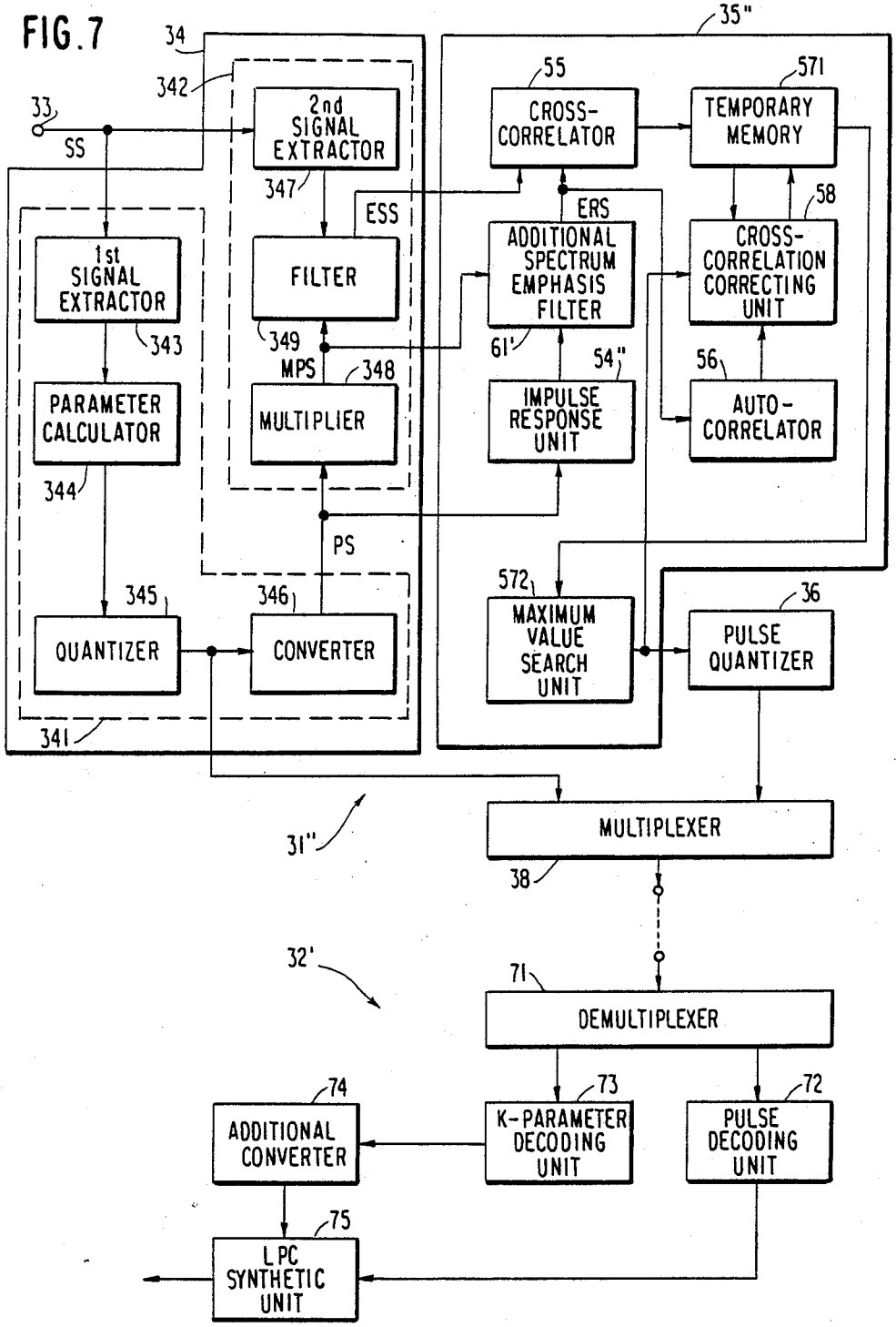
FIG. 7 is a block diagram of an encoder according to a third embodiment of this invention, which is a modification of said first embodiment, and a decoder for use as a counterpart of the encoder.

Referring to FIG. 7, a multi-pulse-type encoder 31'' is used as a third embodiment of this invention in combination with a decoder 32' which is used as a counterpart of the encoder 31''. The encoder 31'' comprises the spectrum emphasis filter 34 described in conjunction with FIGS. 3 and 6.

Practically, the LPC analyzer 341 comprises a first signal extractor 343, a parameter calculator 344, a quantizer 345, and a parameter converter 346. Supplied with the speech signal SS, the first signal extractor 343 extracts a single frame from the speech signal SS by the use of a Hamming window known in the art and delivers a first extracted speech signal to the parameter calculator 344. The parameter calculator 344 calculates k parameters $k_i$ specific to the spectrum envelope of the first extracted speech signal and produces a k parameter signal representative of the k parameters $k_i$. The quantizer 345 quantizes the k parameter signal and sends a quantized k parameter signal to the converter 346. The converter 346 is for converting the k parameters $k_i$ to $\alpha$ parameters $\alpha_i$ related to the k parameters $k_i$. For this purpose, the converter 346, at first, decodes the quantized k parameter signal into a decoded k parameter signal. Subsequently, the converter 346 converts the decoded k parameter signal to an $\alpha$ parameter signal representative of the $\alpha$ parameters $\alpha_i$ and produces the $\alpha$ parameter signal. The $\alpha$ parameter signal is used as the parameter signal PS described in conjunction with FIG. 6.

The spectrum emphasis filter 342 comprises a second signal extractor 347, a multiplier 348, and a filter 349. The second signal extractor 347 also extracts a single frame from the speech signal SS by the use of the Hamming window and produces a second extracted speech signal. The multiplier 348 has attenuation coefficients $\gamma^i$ described in conjunction with FIG. 4. The multiplier 348 multiplies the $\alpha$ parameters $\alpha_1$ by the attenuation coefficients $\gamma^i$ and produces a multiplied parameter signal MPS representative of multiplied parameters $\alpha_i.\gamma^i$.

Supplied with the second extracted speech signal and the multiplied parameter signal MPS, the filter 349 emphasizes the spectrum envelope of the second extracted speech signal in accordance with the multiplied parameter signal. The filter 349 produces an emphasized signal. The emphasized signal is used as the emphasized speech signal ESS described in conjunction with FIG. 6.

The encoder 31'' further comprises a pulse producing unit 35'' supplied with the parameter signal PS, the multiplied parameter signal MPS, and the emphasized speech signal ESS. The pulse producing unit 35'' comprises similar parts designated by like reference numerals as in FIG. 6 except for an impulse response unit 54'' and an additional spectrum emphasis filter 61'.

The impulse response unit 54'' calculates an impulse response of the parameter signal PS and produces an impulse response signal representative of the impulse response. Supplied with the impulse response signal and the multiplied parameter signal MPS, the additional spectrum emphasis filter 61' emphasizes the spectrum envelope of the impulse response signal in accordance with the multiplied parameter signal MPS and produces an emphasized signal. The emphasized signal is used as the emphasized impulse response signal ERS described in conjunction with FIG. 6. The emphasized impulse response signal ERS is therefore delivered to the cross-correlator 55 and the autocorrelator 56 as described in conjunction with FIG. 6. The pulse search operation of the pulse producing unit 35'' will be omitted because the operation is similar to that described in relation to FIG. 6.

The encoder 31'' still further comprises the pulse quantizer 36 and the multiplexer 38 described in conjunction with FIG. 3. The pulse quantizer 36 is supplied with the excitation pulses produced by the pulse producing unit 35'' and quantizes the excitation pulses. The pulse quantizer 36 delivers the quantized pulse signal to the multiplexer 38. The multiplexer 38 is supplied with the quantized pulse signal and the quantized k parameter signal produced by the quantizer 345 and multiplexes the quantized pulse signal and the quantized k parameter signal into the multiplexed signal. The multiplexed signal is transmitted through the transmitter (not shown) to the receiver (not shown) through the transmission medium as described in conjunction with FIG. 3.

In FIG. 7, the decoder 32' comprises a demultiplexer 71, a pulse decoding unit 72, a k parameter decoding unit 73, an additional converter 74, and an LPC synthetic unit 75. Supplied with the multiplexed signal from the encoder 35'', the demultiplexer 71 demultiplexes the multiplexed signal into a demultiplexed pulse signal and a demultiplexed k parameter signal. The demultiplexed pulse signal is decoded by the pulse decoding unit 72 into a decoded pulse signal. The decoded pulse signal is supplied as reproduced excitation pulses to the LPC synthetic unit 75. On the other hand, the demultiplexed k parameter signal is decoded by the k parameter decoding unit 73 into a decoded k parameter signal. The decoded k parameter signal is supplied as a reproduced k parameter signal to the additional converter 74. The additional converter 74 converts the reproduced k parameter signal to an $\alpha$ parameter signal representative of the $\alpha$ parameters $\alpha_i$ related to the k parameters $k_i$ and sends the $\alpha$ parameter signal to the LPC synthetic unit 75. Supplied with the reproduced excitation pulses and the $\alpha$ parameter signal, the LPC synthetic unit 75 synthesizes the reproduced excitation pulses and the $\alpha$ parameter signal to produce a synthetic speech signal.

While this invention has thus far been described in conjunction with a few preferred embodiments thereof, it will readily be possible for those skilled in the art to put this invention into practice in various other manners. For example, the pulse search operation of the pulse producing unit may be repeated during one frame of the emphasized speech signal until an amplitude level of one of the excitation pulses decreases to a predetermined amplitude level. A few spectrum emphasis units may be connected in cascade. Furthermore, the encoder may be combined with a perceptual weighting filter known in the art.

What is claimed is:

1. An encoder for use in encoding a speech signal into a plurality of pulse signals, each having an amplitude and a location determined by said speech signal, said speech signal having spectrum envelope which has a plurality of peak components, wherein the improvement comprises:

parameter calculating means responsive to said speech signal for calculating parameters specific to said spectrum envelope to produce a parameter signal representative of said parameters:

a spectrum emphasis filter responsive to said speech signal and said parameter signal for emphasizing said peak components of said spectrum envelope to produce an emphasized speech signal in accordance with said parameter signal, said emphasized speech signal having spectrum envelope which substantially comprises a plurality of line spectra; and pulse producing means coupled to said spectrum emphasis filter for reproducing said plurality of pulse signals in response to said emphasized speech signal.

2. An encoder as claimed in claim 1, wherein said parameter calculating means comprises:

a calculator responsive to said speech signal for calculating k parameters specific to said speech signal to produce a k-parameter signal representative of said k parameters;

a quantizer responsive to said k parameter signal for quantizing said k parameter signal to produce a quantized k parameter signal; and a converter responsive to said quantized k parameter signal for converting said k parameters to $\alpha$ parameters related to said k parameters to produce an $\alpha$ parameter signal as said parameter signal.

3. An encoder as claimed in claim 2, wherein said spectrum emphasis filter comprises:

multiplying means responsive to said parameter signal for multiplying said $\alpha$ parameters represented by said $\alpha$ parameter signal by attenuation coefficients to produce a multiplied parameter signal; and a filter responsive to said speech signal and said multiplied parameter signal for producing said emphasized speech signal in accordance with said multiplied parameter signal.

4. An encoder as claimed in claim 1, wherein said pulse producing means comprises:

additional parameter calculating means responsive to said emphasized speech signal for calculating additional parameters specific to said emphasized speech signal to produce an additional parameter signal representative of said additional parameters;

impulse response calculating means coupled to said additional parameter calculating means and responsive to said additional parameter signal for calculating an impulse response of said additional parameter signal to produce an impulse response signal representative of said impulse response;

autocorrelation calculating means responsive to said impulse response signal for calculating autocorrelation related to said impulse response signal to produce an autocorrelation signal representative of said autocorrelation;

cross-correlation calculating means responsive to said emphasized speech signal and said impulse response signal for calculating cross-correlation between said emphasized speech signal and said impulse response signal to produce a cross-correlation signal representative of said cross-correlation;

correcting means responsive to said plurality of pulse signals, said autocorrelation signal, and said cross-correlation signal for correcting said cross-correlation in accordance with said autocorrelation signal and said plurality of pulse signals to produce a corrected cross-correlation signal representative of corrected cross-correlation; and pulse generating means coupled to said cross-correlation calculating means and said correcting means for generating said plurality of pulse signals in response to said cross-correlation signal and said corrected cross-correlation signal.

5. An encoder as claimed in claim 3, wherein said pulse producing means is coupled to said parameter calculating means and said spectrum emphasis filter and comprises:

impulse response calculating means coupled to said parameter calculating means and responsive to said parameter signal for calculating an impulse response of said parameter signal to produce an impulse response signal representative of said impulse response;

an additional spectrum emphasis filter coupled to said parameter calculating means and said impulse response calculating means for emphasizing peak components of the spectrum envelope of said impulse response signal in accordance with said parameter signal to produce an emphasized impulse response signal;

autocorrelation calculating means responsive to said emphasized impulse response signal for calculating autocorrelation related to said emphasized impulse response signal to produce an autocorrelation signal representative of said autocorrelation;

cross-correlation calculating means coupled to said spectrum emphasis filter and said additional spectrum emphasis filter for calculating cross-correlation between said emphasized speech signal and said emphasized impulse response signal to produce a cross-correlation signal representative of said cross-correlation;

correcting means responsive to said plurality of pulse signals, said autocorrelation signal, and said cross-correlation signal for correcting said cross-correlation signal in accordance with said autocorrelation signal and said plurality of pulse signals to produce a corrected cross-correlation signal representative of corrected cross-correlation; and pulse generating means coupled to said cross-correlation calculating means and said correcting means for generating said plurality of pulse signals in response to said cross-correlation signal and said corrected cross-correlation signal.

* * * * *